US009508331B2

(12) United States Patent
Wang

(10) Patent No.: US 9,508,331 B2
(45) Date of Patent: Nov. 29, 2016

(54) COMPOSITIONAL METHOD, COMPOSITIONAL PROGRAM PRODUCT AND COMPOSITIONAL SYSTEM

(71) Applicant: VONTAGE CO., LTD., New Taipei (TW)

(72) Inventor: Hsi-Chun Wang, New Taipei (TW)

(73) Assignee: Vontage Co., Ltd., New Taipei (TW)

( * ) Notice: Subject to any disclaimer, the term of this patent is extended or adjusted under 35 U.S.C. 154(b) by 0 days.

(21) Appl. No.: 14/586,147

(22) Filed: Dec. 30, 2014

(65) Prior Publication Data

US 2015/0325225 A1 Nov. 12, 2015

(30) Foreign Application Priority Data

May 7, 2014 (TW) ..... 103116286 A

(51) Int. Cl.
*G10H 1/40* (2006.01)
*G10H 1/42* (2006.01)
*G10H 1/00* (2006.01)

(52) U.S. Cl.
CPC ..... *G10H 1/42* (2013.01); *G10H 1/0008* (2013.01); *G10H 1/40* (2013.01); *G10H 2220/261* (2013.01); *G10H 2230/015* (2013.01)

(58) Field of Classification Search
CPC ..... G10H 1/40; G10H 1/0008; G10H 1/42; G10H 2230/015; G10H 2220/261
USPC ..... 84/611
See application file for complete search history.

(56) References Cited

U.S. PATENT DOCUMENTS 3,698,277 A * 10/1972 Barra ..... G10G 1/00 84/483.1
4,958,551 A * 9/1990 Lui ..... G09B 15/023 84/462
4,960,031 A * 10/1990 Farrand ..... G09B 15/023 84/462
5,146,833 A * 9/1992 Lui ..... G09B 15/023 84/462
5,202,526 A * 4/1993 Ohya ..... G10H 1/0041 84/462
7,514,622 B2 * 4/2009 Yoshikawa ..... G10H 1/0041 84/477 R
8,222,507 B1 * 7/2012 Salazar ..... G10H 1/0008 84/602
2004/0206225 A1 * 10/2004 Wedel ..... G09B 15/02 84/477 R
2006/0011044 A1 * 1/2006 Chew ..... G10H 1/34 84/609
2011/0192270 A1 * 8/2011 Saxby ..... G09B 15/026 84/483.2
2013/0070093 A1 * 3/2013 Rivera ..... G11B 27/002 348/143

(Continued)

FOREIGN PATENT DOCUMENTS

WO 2006/019535 A2 2/2006

*Primary Examiner* — David Warren
*Assistant Examiner* — Christina Schreiber
(74) *Attorney, Agent, or Firm* — Muncy, Geissler, Olds & Lowe, P.C.

(57) ABSTRACT

A compositional method, compositional program product and compositional system are provided. The compositional method essentially includes: a pitch input step for allowing a user to enter pitch marks sequentially displayed on a display unit; and a beat input step for providing a hint signal at each beat in accordance with a predetermined tempo so that in a hint state the user sequentially inputs action signals in accordance with a rhythm, wherein points in time corresponding to the action signals are sequentially regarded as points in time of the pitch marks, and the pitch marks which the points in time are allocated to are sequentially defined as completed notes, thereby forming a musical composition. The compositional program product is executed by an electronic device to effectuate the compositional method. The compositional system effectuates composing in conjunction with a pitch input interface and a beat input interface of the electronic device.

15 Claims, 10 Drawing Sheets

(56) References Cited

U.S. PATENT DOCUMENTS

2013/0112062 A1* 5/2013 Iriyama ..... G10H 1/0008 84/453
2014/0047971 A1* 2/2014 Akazawa ..... G10H 1/18 84/609
2015/0317965 A1* 11/2015 Horvath ..... G10H 1/0041 84/609

* cited by examiner

COMPOSITIONAL METHOD, COMPOSITIONAL PROGRAM PRODUCT AND COMPOSITIONAL SYSTEM

BACKGROUND OF THE INVENTION

Field of the Invention

The present invention relates to the technology of musical composing and, more particularly, to a compositional method, compositional program product and compositional system for composing on an electronic device.

Description of the Prior Art

Among compositional program-related techniques, WO 2006/019535A2 discloses using a handheld electronic device to enter numbers, expressing scores by numbered musical notations, and entering duration of notes with numbered keys. Although the aforesaid technique enables composing to be performed with the handheld electronic device, the aforesaid technique has drawbacks as follows: notes and duration are entered one by one and thus in a monotonous, trivial and inconvenient manner.

Conventional compositional programs are capable of allocating pitch and duration (beats) to notes. However, according to the prior art, duration is usually entered with keyboards or symbols. Hitherto, there has not been any compositional program whereby a user provides duration (beat) information to notes intuitively by hand or tool and by percussion or tapping with finger.

BRIEF SUMMARY OF THE INVENTION

It is an objective of the present invention to provide a compositional method, compositional program product and compositional system whereby a user provides duration (beat) information to notes by percussion or tapping with finger.

Another objective of the present invention is to provide a compositional method, compositional program product and compositional system whereby composing is performed in a way more convenient than is disclosed by the prior art.

In order to achieve the above and other objectives, a compositional method of the present invention comprises: a pitch input step for allowing a user to enter a plurality of pitch marks to be stored in a memory and sequentially displayed on a display unit, wherein the pitch marks carry pitch information; and a beat input step for providing a hint signal at each beat in accordance with a predetermined tempo (beat number/minute, BPM, beats per minute) to give a hint to the user so that in a hint state the user sequentially inputs a plurality of action signals in accordance with a rhythm, with the action signals corresponding to the pitch marks, respectively, wherein points in time corresponding to the action signals are sequentially regarded as points in time of the pitch marks, and the pitch marks which the points in time are allocated to are sequentially defined as a plurality of completed notes, sequentially displayed on the display unit, and stored in the memory, wherein the completed notes not only carry pitch information but also carry duration information because of their points in time.

A compositional program product of the present invention, adapted to be loaded into an electronic device and executed to execute a pitch input procedure for performing the pitch input step and execute a beat input procedure for performing the beat input step, so as to effectuate the method.

A compositional system of the present invention comprises: an electronic device having a pitch input interface, a beat input interface, a memory, a display unit, a speaker, and a processor, with the memory storing a pitch input procedure, a play procedure, and a beat input procedure executable by the processor; the pitch input procedure for allowing a user to sequentially enter a plurality of pitch marks through the pitch input interface, with the pitch marks being displayed on the display unit sequentially and carrying pitch information; the play procedure plays the pitch marks or notes and enables the speaker to generate a sound: and the beat input procedure for providing a hint signal at each beat in accordance with a predetermined tempo (beat number/minute, BPM, beats per minute) to give a hint to the user so that in a hint state the user sequentially inputs a plurality of action signals in accordance with a rhythm through the beat input interface, with the action signals corresponding to the pitch marks, respectively, wherein points in time corresponding to the action signals are sequentially regarded as points in time of the pitch marks, and the pitch marks which the points in time are allocated to are sequentially defined as a plurality of completed notes and sequentially displayed on the display unit, wherein the completed notes not only carry pitch information but also carry duration information because of their points in time, wherein the pitch marks and the completed notes are stored in the memory.

The compositional method, compositional program product and compositional system enable the user to provide duration (beat) information for notes by percussion or tapping, so as for the user to compose in a way more convenient than is disclosed by the prior art.

DETAILED DESCRIPTION OF THE INVENTION

Figure 1:
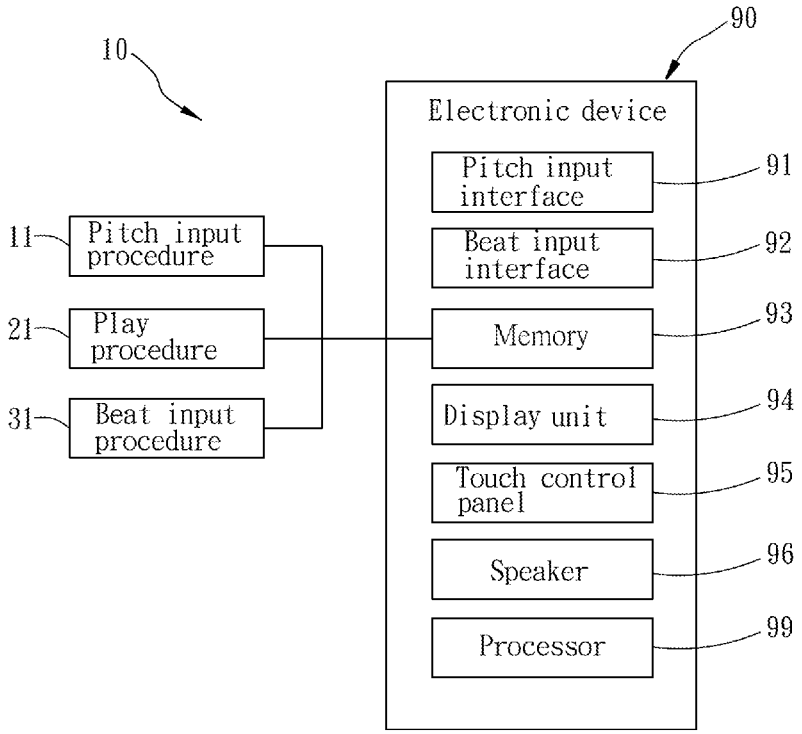
FIG. 1 is a block diagram of the first preferred embodiment of the present invention.

To explain technical features of the present invention, the present invention is illustrated with preferred embodiments in conjunction with drawings and described below.

Referring to FIG. 1 through FIG. 9, in the first preferred embodiment of the present invention, a compositional system 10 comprises an electronic device 90. The electronic device 90 has a pitch input interface 91, a beat input interface 92, a memory 93, a display unit 94, a speaker 96 and a processor 99. The memory 93 stores a pitch input procedure 11, a play procedure 21 and a beat input procedure 31 which are executable by the processor 99.

In the first preferred embodiment, the electronic device 90 is a personal computer, tablet, personal digital assistant (PDA) or smartphone. In the first preferred embodiment, which is exemplified by a smartphone, the electronic device 90 has a touch control panel 95 disposed above the display unit 94, whereas the pitch input interface 91 is a plurality of graphics displayed on the display unit 94 and disposed below the touch control panel 95. A user selects the graphics to enter data. Regarding their appearance, the graphics are numbered keys or any other symbol keys. Alternatively, the graphics are mere graphics. The data thus entered includes numerals or symbols, which represent pitch. The beat input interface 92 is a beat graphic displayed on the display unit 94 and disposed below the touch control panel 95 to allow the user's finger to tap the beat graphic in order to input an action signal Sa. The beat graphic is provided in the form of a key or is a mere graphic. The pitch input interface 91 and the beat input interface 92 coexist on a frame displayed on the display unit 94 or are displayed on two frames, respectively. In the first preferred embodiment, the pitch input interface 91 and the beat input interface 92 are displayed on two frames, respectively.

The pitch input procedure 11 enables the user to enter a plurality of pitch marks M1 sequentially through the pitch input interface 91 and display the pitch marks M1 sequentially with the display unit 94, wherein the pitch marks M1 each contain pitch information. In the first preferred embodiment, upon execution of the pitch input procedure 11 by the processor 99, the pitch of the pitch marks M1 depends on the data entered through the pitch input interface 91.

The play procedure 21 plays the pitch marks M1 or notes and generates a sound through the speaker 96.

The beat input procedure 31 provides a hint signal Sh for each beat in accordance with a predetermined tempo (beat number/minute, beats per minute) to give hints to the user. In a hint state, the user enters a plurality of action signals Sa sequentially through the beat input interface 92 in accordance with a rhythm wanted by the user. The action signals Sa correspond to the pitch marks M1, respectively. The points in time which the action signals Sa correspond to are sequentially regarded as the points in time of the pitch marks M1. The point in time which an action signal Sa corresponds to is defined as the point in time of the start of the duration of the pitch mark M1 corresponding to the action signal Sa and is defined as the point in time of the end of the duration of the preceding pitch mark M1. The pitch marks M1 which the points in time are allocated to are sequentially defined as a plurality of completed notes N2, and the display unit 94 sequentially displays the completed notes N2. The completed notes N2 not only contain pitch information but also contain duration information because of their points in time. Upon receipt of a plurality of action signals Sa, the electronic device 90 uses the speaker 96 to play a predetermined sound (a sound of a musical instrument, a human voice or any sound) of the pitch marks M1 corresponding to the action signals Sa with the play procedure 21; in other words, the sound of the pitch mark M1 corresponding to one said action signal Sa is played and perceived by the user as soon as the action signal Sa is generated. The hint signal Sh is in the form of a sound or an image generated by the electronic device 90. In the first preferred embodiment, a sound and an image coexist, wherein the image is in the form of a beat bar 921 shown in FIG. 4. The electronic device 90 controls the beat bar 921 to first look like a full strip which then shortens gradually while moving down until it disappears before reemerging to lengthen while moving up until it becomes full; hence, the full-disappear-full cycle simulates the user's finger tapping—a vertical movement. Shortening the beat bar 921 while moving the beat bar 921 downward until the beat bar 921 disappears is regarded as generating the hint signal Sh to thereby simulate the points in time of the user's finger tapping. Alternatively, shortening the beat bar 921 while moving the beat bar 921 downward and then lengthening the beat bar 921 while moving the beat bar 921 upward until it becomes full is regarded as generating the hint signal Sh. The user chooses to send the hint signal Sh either at the point in time when the beat bar 921 is full or at the point in time when the beat bar 921 disappears. Furthermore, the speaker 96 is configured to generate a sound as soon as the electronic device 90 uses the speaker 96 for generating a sound in lieu of sending the hint signal Sh, wherein the point in time when the sound is generated is the point in time when the hint signal Sh is sent.

Figure 3:
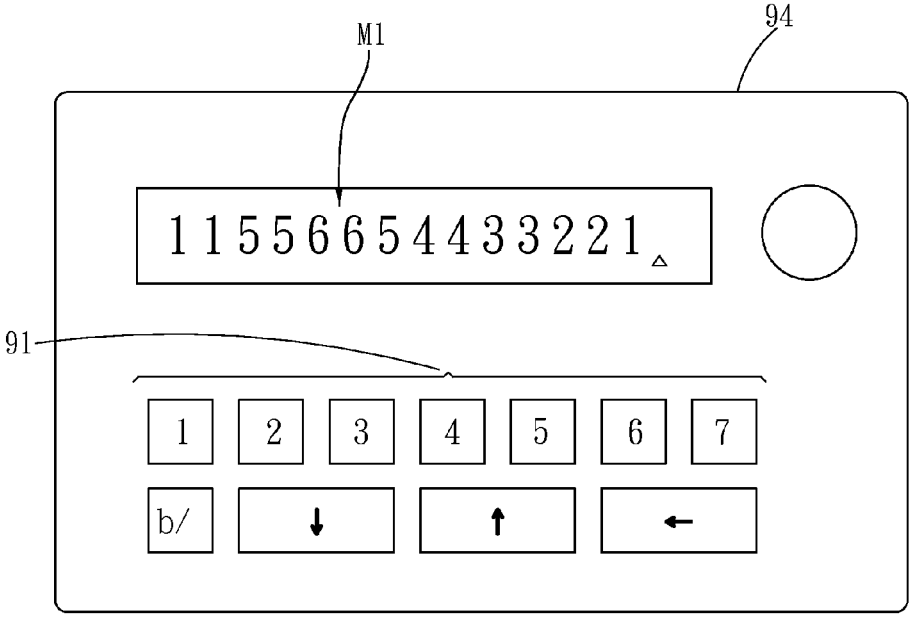
FIG. 3 is a schematic view of a pitch input interface according to the first preferred embodiment of the present invention.
Figure 4:
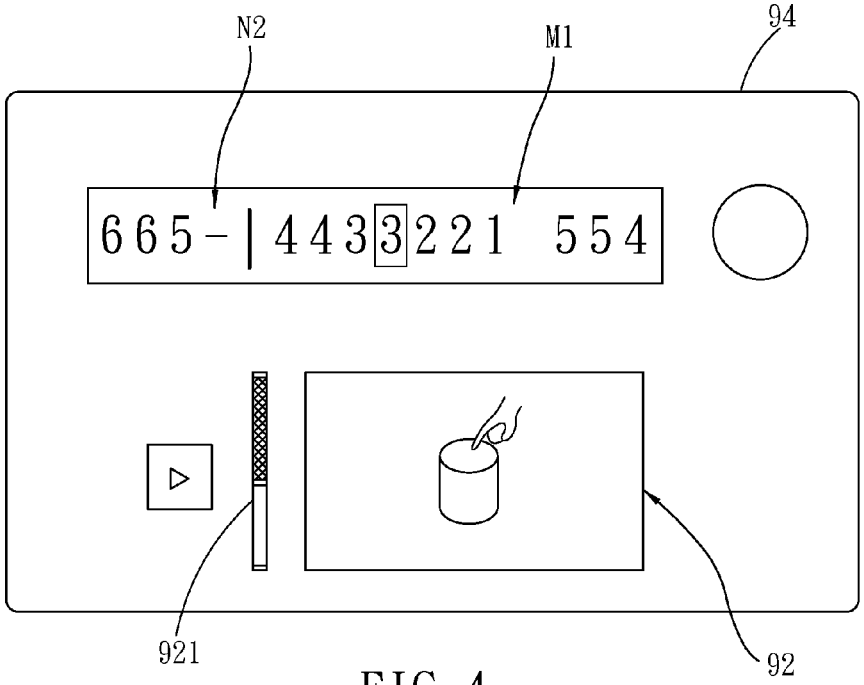
FIG. 4 is a schematic view of a beat input interface according to the first preferred embodiment of the present invention.

The pitch marks M1 and the completed notes N2 are stored in the memory 93. In the first preferred embodiment, the pitch marks M1 or the completed notes N2 displayed on the display unit 94 are in the form of numbered musical notations, staffs, staffs with six lines, combinations of pitch symbols or musical instrument notations. FIG. 3 and FIG. 4 are exemplified by numbered musical notations.

The structure of the compositional system 10 in the first preferred embodiment is described above. The operation of the compositional system 10 in the first preferred embodiment is described below with reference to the compositional method of the present invention.

Figure 5:
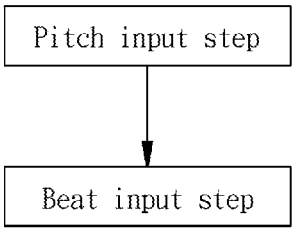
FIG. 5 is a schematic view of the process flow of a method according to the first preferred embodiment of the present invention.
Figure 2:
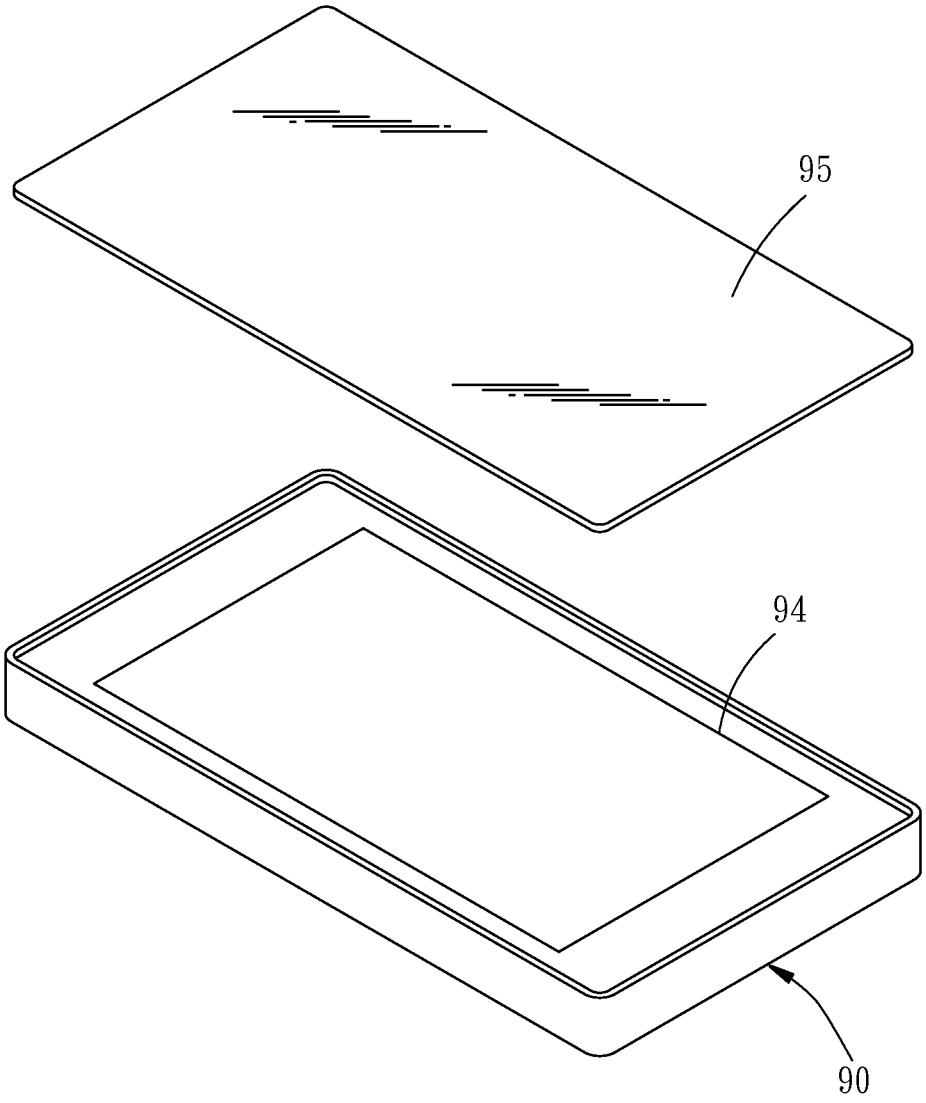
FIG. 2 is an exploded schematic view of an electronic device according to the first preferred embodiment of the present invention.

Referring to FIG. 5, the compositional method of the present invention essentially comprises a pitch input step and a beat input step. The steps are carried out with the compositional system 10.

First, the processor 99 executes the pitch input procedure 11 to perform the pitch input step. The user sees the pitch input interface 91 on the display unit 94 and uses the pitch input interface 91 to sequentially enter a plurality of pitch marks M1; meanwhile, the pitch marks M1, which carry only pitch information but no duration information (i.e., beat information), are displayed on the display unit 94 and stored in the memory 93.

Afterward, to begin the beat input step, the user changes the frame of the display unit 94 so that the beat input interface 92 is displayed, as shown in FIG. 4. As a result, the processor 99 executes the beat input procedure 31 so that the beat input procedure 31 provides a hint signal Sh for each beat in accordance with a predetermined tempo, for example, 60 beats per minute, to give a hint to the user. In response to the hint during the hint state, the user taps the beat input interface 92 and thereby sequentially inputs a plurality of action signals Sa corresponding to the pitch marks M1, respectively. The points in time corresponding to the action signals Sa are sequentially regarded as the points in time of the pitch marks M1 as described in subsequent paragraphs, whereas the electronic device 90 plays the pitch marks M1 corresponding to the tap actions through the speaker 96 so that the user hears them. Hence, the user allocates duration information to the pitch marks M1 in accordance with time intervals of the action signals Sa generated from the tap actions and thereby defines a plurality of completed notes N2. Now, the completed notes N2 contain information pertaining to pitch and duration. After duration information has been allocated to all the pitch marks M1, all completed notes N2 are completed. The combination of the completed notes N2 is a musical composition and is stored in the memory 93, thereby finalizing the composing process. The user can use the electronic device 90 to play the musical composition.

Figure 6:
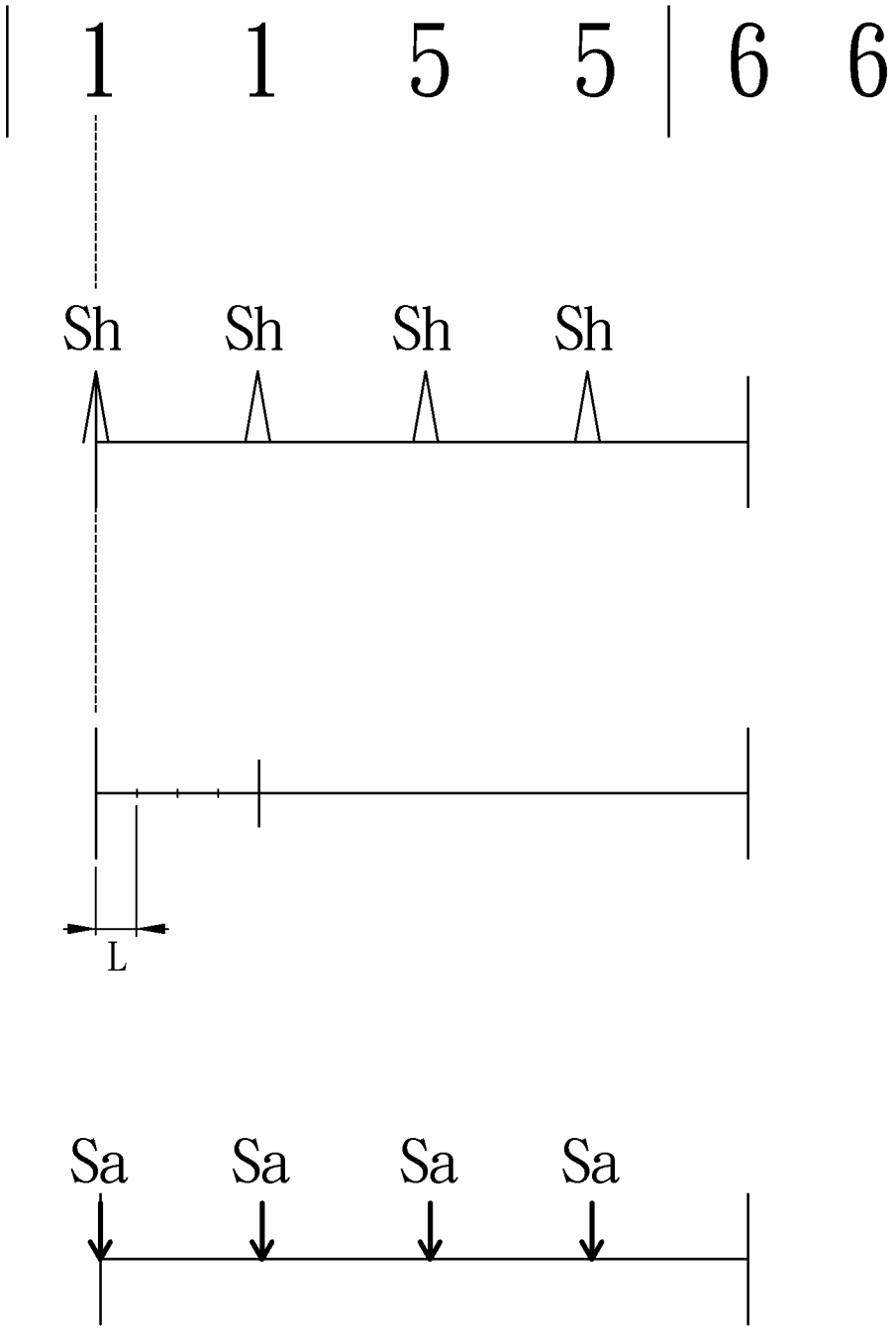
FIG. 6 is a rhythm-based schematic view of the relation between the least duration, action signal and hint signal according to the first preferred embodiment of the present invention.

Referring to FIG. 6, the user's tapping the beat input interface 92 to obtain a plurality of action signals Sa is accompanied by defining a least duration L with the beat input procedure 31 and configuring the temporal length whereby the user can make changes to the least duration L. The least duration L is the least possible duration of input and serves as the least unit for calculating duration. For example, if the least duration L for a syllable of a 4/4 beat is set to 1/4 beat (i.e., sixteenth notes), the beat input procedure 31 will provide the hint signal Sh at the location of each beat so that the hint signal Sh will be provided in four instances within the syllable, and the point in time for the user to tap is determined according to the point in time of every 1/4 beat. Therefore, the duration allocated to the completed notes N2 will be accurate, provided that the user taps punctually.

Figure 7:
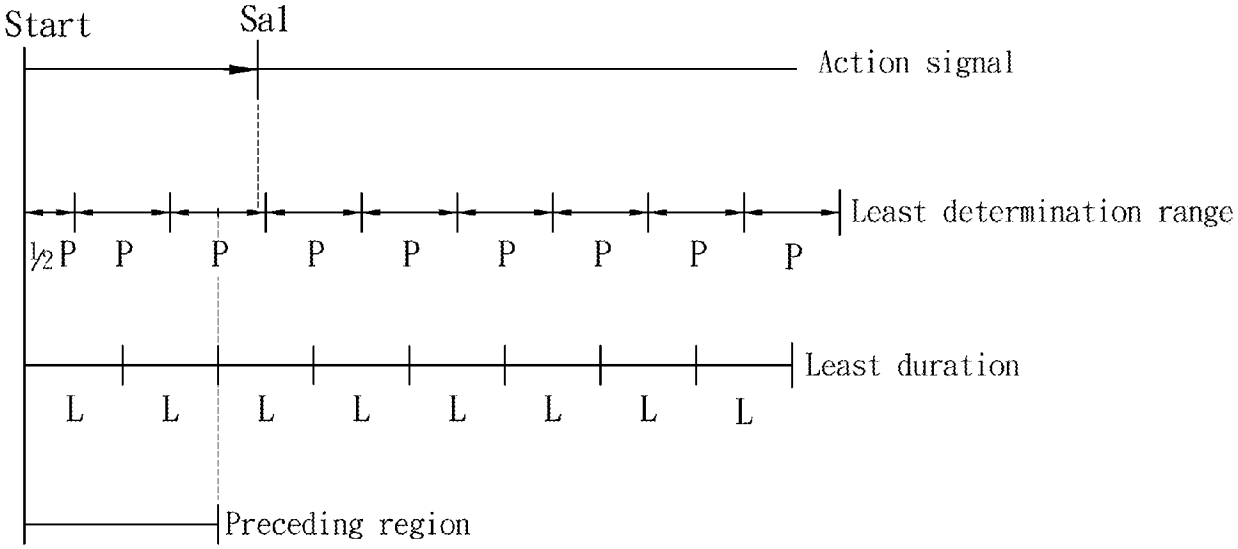
FIG. 7 is an action-based schematic view of the state of determining the first action signal according to the first preferred embodiment of the present invention.
Figure 8:
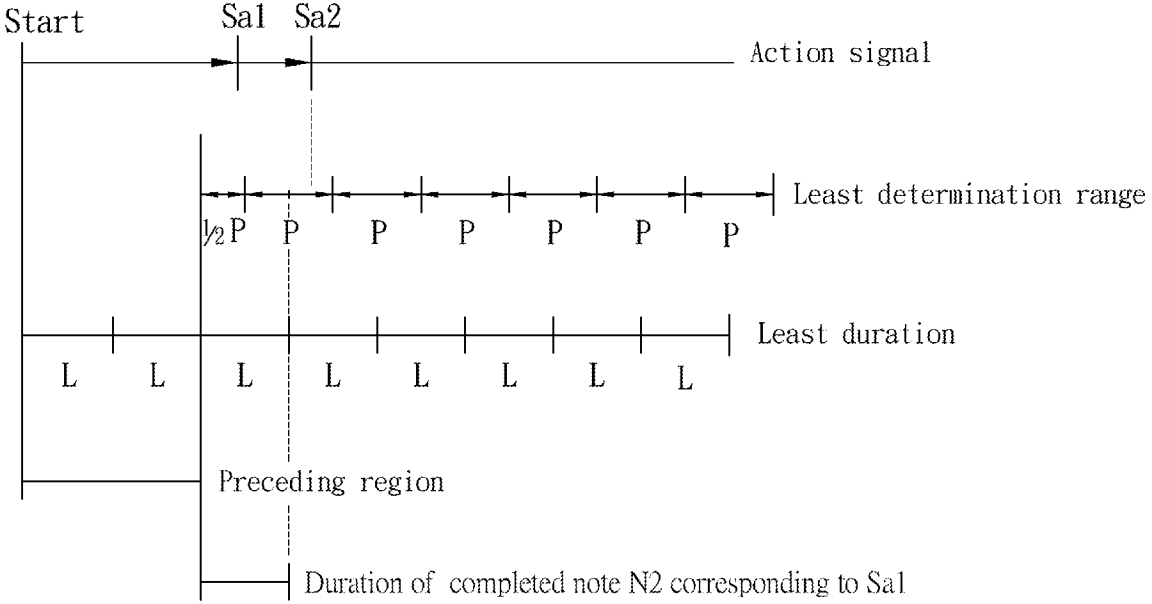
FIG. 8 is an action-based schematic view of the state of determining the second action signal according to the first preferred embodiment of the present invention.
Figure 9:
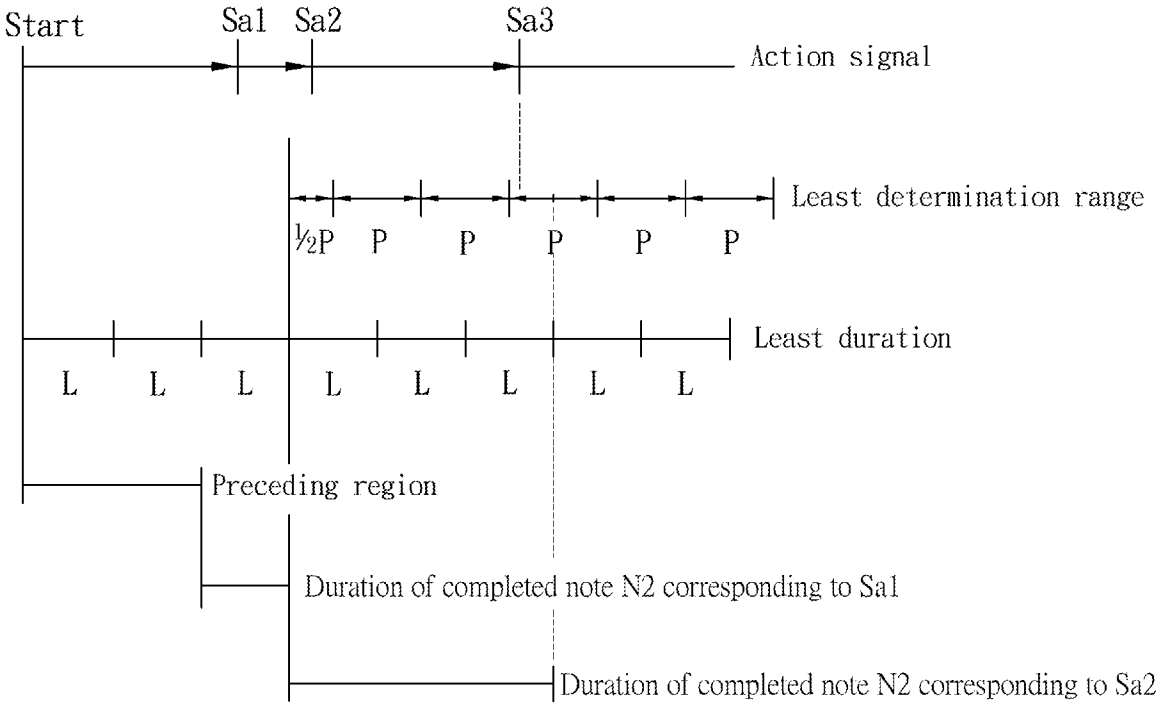
FIG. 9 is an action-based schematic view of the state of determining the third action signal according to the first preferred embodiment of the present invention.

Referring to FIG. 7 through FIG. 9, every point in time when the user taps can be determined more conveniently than described before. FIG. 7 illustrates the determination of the point in time of the action signal Sa1. FIG. 8, which follows FIG. 7, illustrates the determination of the point in time of the action signal Sat. FIG. 9, which follows FIG. 8, illustrates the determination of the point in time of the action signal Sa3. Since human beings are less accurate in tapping according to a tempo than a machine or computer, it is necessary to allow the user to input a beat in a less accurate manner by a means of determination, so as to be determined by the electronic device 90, thereby rendering it easier for the user to input the beat. Referring to FIG. 7 through FIG. 9, the beat input procedure 31 not only defines the least duration L but also defines a least determination range P. The least determination range P has a temporal length identical to the temporal length of the least duration L. With a plurality of continuous least durations L corresponding to a plurality of continuous least determination ranges P, respectively, the course of the user's inputting the action signals Sa1~Sa3 is accompanied by the phenomenon that the points in time corresponding to the action signals Sa1~Sa3 fall within the least determination ranges P, respectively, so as to determine the least durations L corresponding to the action signals Sa1~Sa3. Each least determination range P and a corresponding one of the least durations L are out of phase by a half phase so that the point in time of the middle of each least determination range P corresponds to the point in time of the end of each least duration L. Besides, if at least two action signals exist within a least determination range P. only the first action signal will be determined, whereas the second and the subsequent action signals will be ignored. Hence, if the points in time corresponding to the action signals Sa1~Sa3 fall within the least determination ranges P, respectively, it will be feasible to define the points in time corresponding to the action signals Sa1~Sa3 as the points in time of the end of the least durations L corresponding to the points in time of the middle of the least determination ranges P. Therefore, to input the action signals Sa, the user need not tap as accurately as a machine and still allow the electronic device 90 to make an accurate determination. The resolution of determining the points in time of the action signals Sa is changed by changing the length of the least durations L and the least determination ranges P.

FIG. 7 through FIG. 9 are further explained below. From the very beginning, the user can configure the beat input procedure 31 to start a beat input action, that is, the beat input action starts as the first instance of percussing the beat input interface 92. Referring to FIG. 7, when the first action signal (i.e., Sa1) is generated, the first determination range (i.e., the determination range of (1/2)P as shown in the diagrams) is ignored. Hence, if the point in time corresponding to the first action signal (i.e., Sa1) falls within the determination range of the first (1/2)P, the action signal will be ignored. Referring to FIG. 7, the point in time corresponding to the first action signal Sa1 falls within the second complete determination range P which follows the determination range of the first (1/2)P, and thus the determination range P and the point in time of the end of the least duration L corresponding to the action signal Sa1 can be determined; hence, the point in time corresponding to the first action signal Sa1 functions as the point in time of the start of the duration of the first completed note N2 and is preceded by a preceding region during which no pitch mark M1 is played. Referring to FIG. 8, if the point in time when the second action signal Sa2 is generated falls within the determination range P corresponding to the first action signal Sa1, the second action signal Sa2 will be ignored, because the determination range P already corresponds to the first action signal Sa1. Referring to FIG. 8, the point in time corresponding to the action signal Sa2 does not fall within the determination range P corresponding to the first action signal Sa1, and thus the action signal Sa2 is a valid action signal. Afterward, the point in time of the end of the least duration L corresponding to the action signal Sa2 is determined and regarded as the point in time of the start of the duration of the second completed note N2 and as the point in time of the end of the duration of the first completed note N2. Referring to FIG. 8, the duration of the first completed note N2 is one least duration L. Referring to FIG. 9, when the third action signal Sa3 is generated, the duration of the second completed note N2 is determined to be three least durations L in accordance with the aforesaid rule so that any other subsequent action signals can be determined.

Regarding the aforesaid action, the last action signal Sa corresponds to the point in time of the start of the duration of the last completed note N2; hence, either the user generates an additional action signal Sa to specify the point in time of the end of the duration of the last completed note N2, or the processor 99 defines the remaining time for the syllable associated with the last completed note N2 as the duration of the last completed note N2.

Hence, the compositional system 10 and compositional method in the first preferred embodiment enable the user to provide duration (beat) information for notes by percussion or tapping, so as for the user to compose in a way more convenient than is disclosed by the prior art.

A compositional program product is produced in accordance with the steps of the compositional method of the present invention. After the compositional program product is loaded into the electronic device 90 and executed, the pitch input procedure 11 is executed to perform the pitch input step, whereas the beat input procedure 31 is executed to perform the beat input step, so as to effectuate the compositional method.

Figure 10:
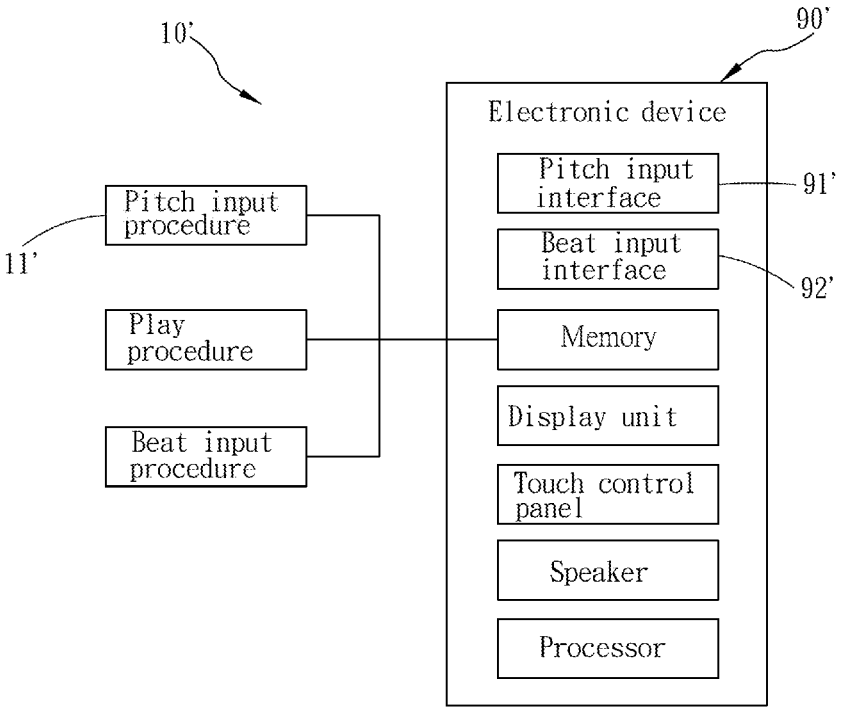
FIG. 10 is a block diagram of the second preferred embodiment of the present invention.
Figure 11:
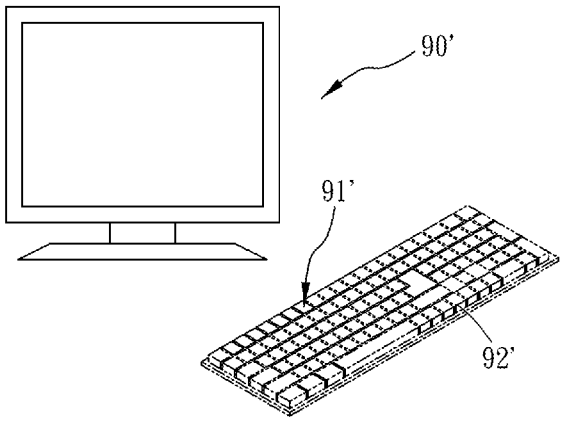
FIG. 11 is a schematic view of the appearance of the electronic device according to the second preferred embodiment of the present invention.

Referring to FIG. 10 and FIG. 11, a compositional system 10' in the second preferred embodiment is distinguished from its counterpart in the first preferred embodiment by technical features described below.

The electronic device 90' is a personal computer. The pitch input interface 91' is a physical keyboard rather than a touch control panel. When the pitch input procedure 11' is executed by the electronic device 90', the pitch of the pitch marks is determined in accordance with the data entered through the pitch input interface 91'. The beat input interface 92' is a physical beat key for generating an action signal when pressed (not shown in FIG. 10 and FIG. 11, please reference to FIG. 6).

In the second preferred embodiment, the beat input interface 92' is not necessarily a physical beat key but includes any other input apparatus, for example, an electronic drum or a light sensor, and can generate an action signal as well.

The other structures and advantages thereof in the second preferred embodiment are substantially identical to their counterparts in the first preferred embodiment and thus are not reiterated for the sake of brevity.

Figure 12:
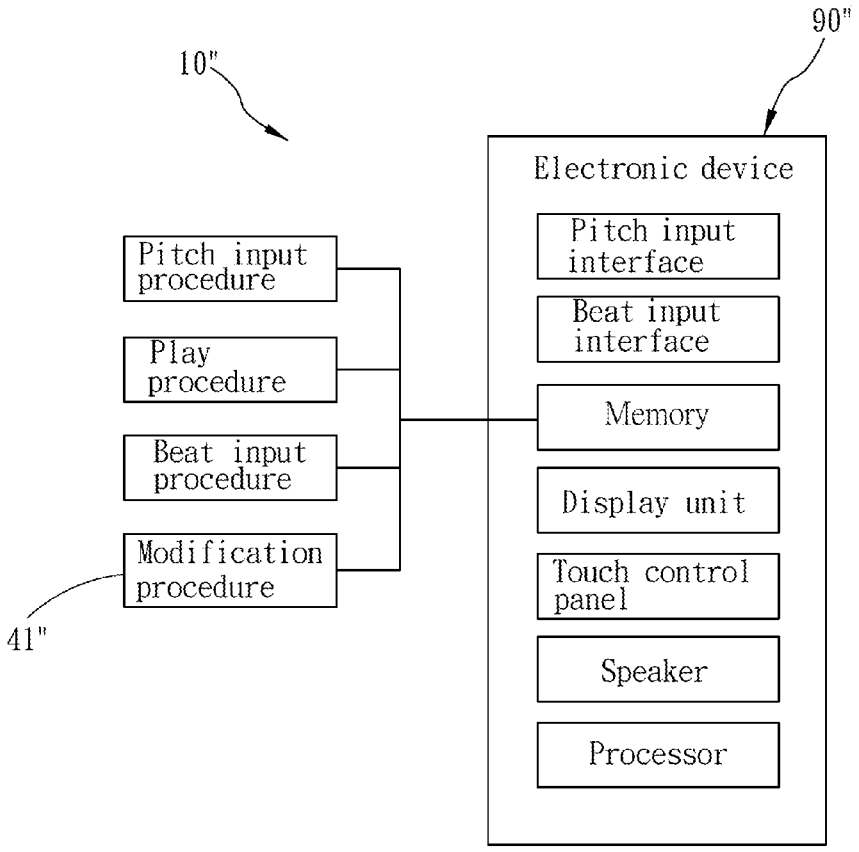
FIG. 12 is a block diagram of the third preferred embodiment of the present invention.
Figure 13:
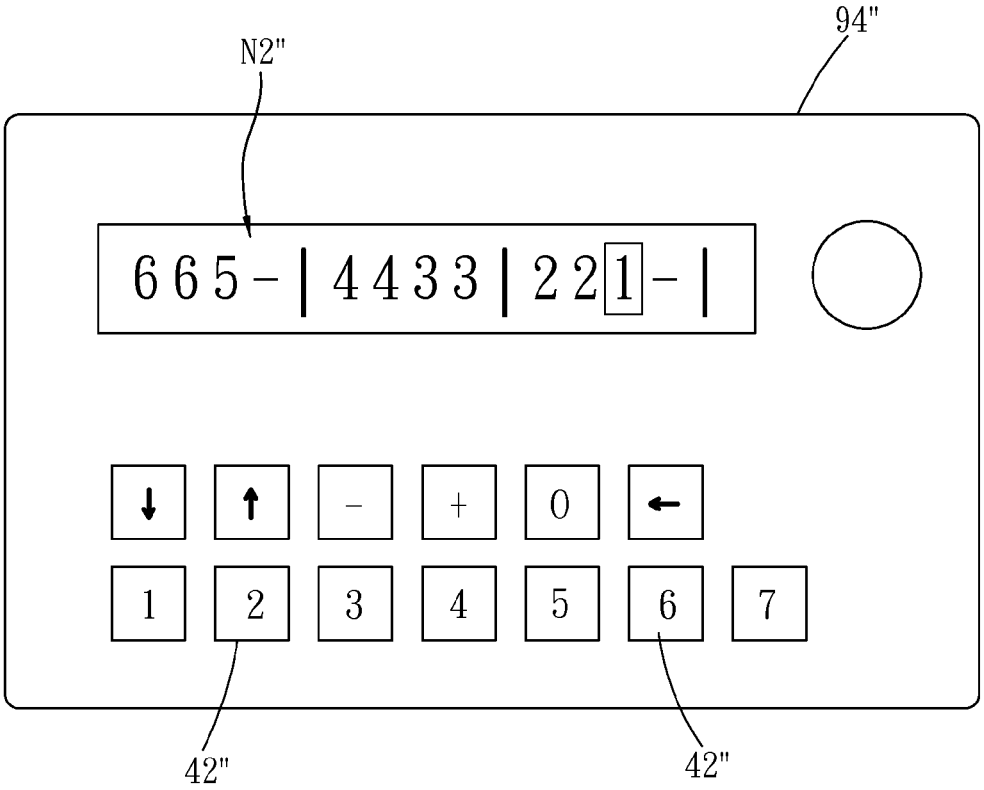
FIG. 13 is a schematic view of modification keys and completed notes according to the third preferred embodiment of the present invention.
Figure 14:
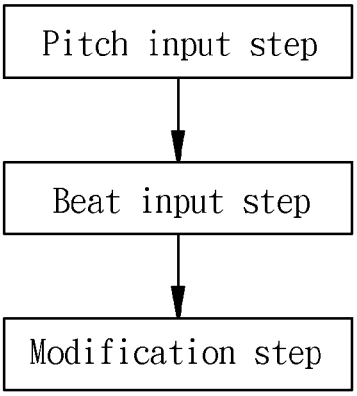
FIG. 14 is a schematic view of the process flow of a method according to the third preferred embodiment of the present invention.

Referring to FIG. 12 through FIG. 14, a compositional system 10" in the third preferred embodiment is distinguished from its counterpart in the first preferred embodiment by technical features described below.

The compositional system 10" further comprises a modification procedure 41" executed by the electronic device 90" to adjust the pitch and duration of the completed notes N2", provide grace notes, rest, timbre, high/low octave, breath signs, expression signs or strength signs at the completed notes N2" or between the completed notes N2", and provide meter, chord or tonality. Referring to FIG. 13, multiple modification keys 42" are displayed on the display unit 94" to correspond to the aforesaid functions, respectively, and perform the aforesaid functions, respectively, when selected by the user.

Referring to FIG. 14, in the third preferred embodiment, the compositional method further comprises a modification step effectuated by the modification procedure 41" to provide grace notes, rest, timbre, high/low octave, breath signs, expression signs or strength signs at the completed notes N2" or between the completed notes N2" and provide meter, chord or tonality.

In practice, the completed notes N2" are selected to provide the aforesaid adjustment with respect to the completed notes N2". Alternatively, the aforesaid additional functions are provided through the modification keys 42". Hence, a musical composition thus created is sophisticated and complete. Likewise, the modification keys 42" are not necessarily keys but include any other graphics to be selected by the user.

The other structures and advantages thereof in the third preferred embodiment are substantially identical to their counterparts in the first preferred embodiment and thus are not reiterated for the sake of brevity.

What is claimed is:

1. A compositional method, comprising:

a pitch input step for allowing a user to enter a plurality of pitch marks to be stored in a memory and sequentially displayed on a display unit, wherein the pitch marks carry pitch information; and a beat input step for providing a hint signal at each beat in accordance with a predetermined tempo (beat number/minute, BPM, beats per minute) to give a hint to the user so that in a hint state the user sequentially inputs a plurality of action signals in accordance with a rhythm, with the action signals corresponding to the pitch marks, respectively, wherein points in time corresponding to the action signals are sequentially regarded as points in time of the pitch marks, and the pitch marks which the points in time are allocated to are sequentially defined as a plurality of completed notes, sequentially displayed on the display unit, and stored in the memory, wherein the completed notes not only carry pitch information but also carry duration information because of their points in time.

2. The compositional method of claim 1, wherein a least duration and a least determination range are defined, with the least duration being the shortest possible duration of input with the least determination range having a temporal length identical to the temporal length of the least duration, with a plurality of continuous least durations corresponding to a plurality of continuous least determination ranges, respectively, wherein, while the user is inputting the action signals, the points in time corresponding to the action signals fall within the least determination ranges, respectively, so as to determine the least durations corresponding to the action signals, respectively.

3. The compositional method of claim 2, wherein each said least determination range and a corresponding one of the least durations are out of phase by a half phase so that the point in time of the middle of each least determination range corresponds to the point in time of the end of each least duration, wherein, if the point in time corresponding to one said action signal falls within a specific least determination range, the point in time of the end of the least duration corresponding to the point in time of the middle of the least determination range which the point in time corresponding to the action signal is located at is defined.

4. The compositional method of claim 1, wherein the pitch marks corresponding to the action signals are played in form of a predetermined sound when the user sequentially inputs a plurality of action signals in accordance with a rhythm, the predetermined sound being a sound of a musical instrument, a human voice or any sound, wherein the hint signal is in form of a sound or an image.

5. The compositional method of claim 1, further comprising a modification step for adjusting pitch and duration of the completed notes.

6. A compositional program product, adapted to be loaded into an electronic device and executed to execute a pitch input procedure for performing the pitch input step and execute a beat input procedure for performing the beat input step, so as to effectuate the method of claim 1.

7. A compositional system, comprising:

an electronic device having a pitch input interface, a beat input interface, a memory, a display unit and a processor, with the memory storing a pitch input procedure and a beat input procedure executable by the processor;

the pitch input procedure for allowing a user to sequentially enter a plurality of pitch marks through the pitch input interface, with the pitch narks being displayed on the display unit sequentially and carrying pitch information; and the beat input procedure for providing a hint signal at each beat in accordance with a predetermined tempo (beat number/minute, BPM, beats per minute) to give a hint to the user so that in a hint state the user sequentially inputs a plurality of action signals in accordance with a rhythm through the beat input interface, with the action signals corresponding to the pitch marks, respectively, wherein points in time corresponding to the action signals are sequentially regarded as points in time of the pitch marks, and the pitch marks which the points in time are allocated to are sequentially defined as a plurality of completed notes and sequentially displayed on the display unit, wherein the completed notes not only carry pitch information but also carry duration information because of their points in time, wherein the pitch marks and the completed notes are stored in the memory.

8. The compositional system of claim 7, further comprising a speaker, with a play procedure stored in the memory and executed by the processor, wherein the play procedure plays the pitch marks or notes and allows the speaker to generate a sound.

9. The compositional system of claim 8, wherein the pitch marks corresponding to the action signals are played with the speaker in form of a predetermined sound when the user sequentially inputs a plurality of action signals through the beat input interface in accordance with a rhythm, the predetermined sound being a sound of a musical instrument, a human voice or any sound.

10. The compositional system of claim 8, wherein the hint signal is in form of a sound or an image generated from the electronic device, and the sound is played with the speaker, whereas the image is displayed on the display unit.

11. The compositional system of claim 7, wherein the beat input procedure defines a least duration and a least determination range, the least duration being the shortest possible duration of input, with the least determination range having a temporal length identical to the temporal length of the least duration, with a plurality of continuous least durations corresponding to a plurality of continuous least determination ranges, respectively, wherein, while the user is inputting the action signals, the points in time corresponding to the action signals fall within the least determination ranges, respectively, so as to determine the least durations corresponding to the action signals, respectively.

12. The compositional system of claim 11, wherein each said least determination range and a corresponding one of the least durations are out of phase by a half phase so that the point in time of the middle of each least determination range corresponds to the point in time of the end of each least duration, wherein, if the point in time corresponding to one said action signal falls within a specific least determination range, the point in time of the end of the least duration corresponding to the point in time of the middle of the least determination range which the point in time corresponding to the action signal is located at is defined.

13. The compositional system of claim 7, wherein the pitch input interface of the electronic device is a physical keyboard, wherein, when the pitch input procedure is executed, the pitch of the pitch marks is determined in accordance with data entered through the pitch input interfaces, wherein the beat input interface of the electronic device is a physical beat key, for generating one said action signal when pressed.

14. The compositional system of claim 7, wherein the electronic device has a touch control panel disposed above the display unit, with the pitch input interface being a plurality of graphics displayed on the display unit and disposed below the touch control panel so that the user selects the graphics to enter data, wherein, when the pitch input procedure is executed, the pitch of the pitch marks is determined by data entered through the pitch input interface, with the beat input interface being a beat graphic displayed on the display unit and disposed below the touch control panel so that the user taps the beat graphic to enter one said action signal.

15. The compositional system of claim 7, further comprising a modification procedure stored in the memory and executed by the processor to adjust the pitch and duration of the completed notes.

* * * * *